US007438037B2

(12) United States Patent
Oogake et al.

(10) Patent No.: US 7,438,037 B2
(45) Date of Patent: Oct. 21, 2008

(54) INTERNAL COMBUSTION ENGINE AND LINER INSTALLATION RING

(75) Inventors: Kazuhiko Oogake, Kashiwazaki (JP); Masaki Yamada, Kashiwazaki (JP); Kazuki Satou, Kashiwazaki (JP)

(73) Assignee: Kabushiki Kaisha Riken, Tokyo (JP)

( * ) Notice: Subject to any disclaimer, the term of this patent is extended or adjusted under 35 U.S.C. 154(b) by 237 days.

(21) Appl. No.: 10/575,793

(22) PCT Filed: Oct. 15, 2004

(86) PCT No.: PCT/JP2004/015277

§ 371 (c)(1),
(2), (4) Date: Apr. 14, 2006

(87) PCT Pub. No.: WO2005/045222

PCT Pub. Date: May 19, 2005

(65) Prior Publication Data

US 2007/0107689 A1 May 17, 2007

(30) Foreign Application Priority Data

Oct. 16, 2003 (JP) ..... 2003-357048

(51) Int. Cl.
*F02F 1/20* (2006.01)

(52) U.S. Cl. ..... 123/193.2; 123/193.3

(58) Field of Classification Search ..... 123/193.2, 123/193.3, 193.4, 193.6
See application file for complete search history.

(56) References Cited

U.S. PATENT DOCUMENTS

| | | | | |
|---|---|---|---|---|
| 6,158,407 | A * | 12/2000 | Mizutani | 123/193.2 |
| 6,164,260 | A * | 12/2000 | Bock | 123/193.2 |
| 6,367,463 | B1 * | 4/2002 | Nurmi | 123/668 |
| 2005/0279296 | A1 * | 12/2005 | Coney et al. | 120/41.84 |

FOREIGN PATENT DOCUMENTS

| | | |
|---|---|---|
| JP | SHO 58-81347 U2 | 6/1983 |
| JP | 8-338301 | 12/1996 |
| JP | 11-294255 | 10/1999 |

* cited by examiner

*Primary Examiner*—M. McMahon
(74) *Attorney, Agent, or Firm*—Husch Blackwell Sanders LLP

(57) ABSTRACT

An internal combustion engine includes: a cylinder block having one or more cylinders, a cylinder liner in a tubular shape disposed inside the cylinder; a piston reciprocating inside the cylinder liner and having a top land portion formed of an outer periphery of the piston sandwiched between a piston head and an uppermost ring groove; and a liner installation ring forming, inside the cylinder, a circular step portion protruding toward the inner periphery of the cylinder liner. The liner installation ring is disposed in the cylinder block or the cylinder liner in such a manner that the bottom face of the liner installation ring face to the uppermost portion of the cylinder liner. The liner installation ring is disposed at a position in accordance with the upper end position of the top land portion when the piston reaches a top dead center. The liner installation ring is set to protrude from the inner periphery of the cylinder liner in an inward direction at a length of 0.05 mm or more to 0.5 mm less.

11 Claims, 9 Drawing Sheets

INTERNAL COMBUSTION ENGINE AND LINER INSTALLATION RING

CROSS REFERENCE TO RELATED APPLICATION

This application is a U.S. nationalization of International Application PCT/JP2004/15277, filed Oct. 15, 2004, which claims the benefit of priority from Japanese Patent Application No. 2003-357048, filed Oct. 16, 2003.

TECHNICAL FIELD OF THE INVENTION

The present invention relates to an internal combustion engine which has a liner installation ring for forming a circular projection in a cylinder, and in particular, reduces oil consumption and prevents a cylinder liner from dropping off due to a pressure from the liner installation ring.

TECHNOLOGICAL BACKGROUND

It is known that the friction loss between a piston ring and a piston largely accounts for that of the whole internal combustion engine. In recent years, decrease in the friction loss has been strongly demanded in order to increase the fuel efficiency of the internal combustion engine. Reducing the tension of the piston ring can be a way to reduce the friction of the piston ring. Reduction in the tension of the piston ring, however, conflicts with oil consumption of the internal combustion engine. Thus, it has been required to realize measures for reducing the oil consumption and reducing: the tension of the piston ring at the same time.

Known internal combustion engines such as a diesel engine include an anti-polish ring (also called a protect ring or a fire ring) attached to an uppermost portion of a cylinder liner. The anti-polish ring scrapes off combustion products (carbon) piled on a top land portion of the piston (an external periphery between a piston head and an uppermost ring groove). Thus, it is possible to prevent lopsided abrasion (carbon polish abrasion) due to the contact between the carbon and the cylinder liner, and the ascent of oil into a combustion chamber. Therefore, the oil consumption is reduced (refer to patent document 1).

In order to reduce oil consumption, Patent document 2 discloses a technology to prevent the oil from being scattered into the combustion chamber, in which the ring is provided above the piston head when the piston is in a top dead center to have the oil collide against the bottom face of the ring.

The anti-polish ring, on the other hand, is mainly applied to a large-displacement engine such as the diesel engine in many cases. In the diesel engine, the anti-polish ring is fitted into a step portion that is formed in an uppermost portion of the inner periphery of the cylinder liner. The cylinder liner is fixed inside a cylinder of a cylinder block by being latched on an upper side. Therefore, if the anti-polish ring is pressed and clamped together from upward by a cylinder head, the cylinder liner does not drop off downwardly.

Patent document 1: Japanese Unexamined Patent Application Publication No. Hei 11-294255

Patent document 2: Japanese Unexamined Patent Application Publication No. Hei 8-338301

DISCLOSURE OF THE INVENTION

Problems to be Solved by the Invention

Publicly known documents such as patent document 1 has not considered the amount of protrusion of the anti-polish ring from the inner periphery of the cylinder liner, the shape of the anti-polish ring to reduce the oil consumption, and the like. When the amount of protrusion of the anti-polish ring is reduced, however, clearance between the anti-polish ring and the outer periphery of the piston is increased. Thus, the amount of the oil ascending into the combustion chamber is increased, so that the effect of restraining the oil consumption cannot be desired. When the amount of protrusion of the anti-polish ring is too large, on the other hand, the following problems occur.

(1) To increase the amount of protrusion of the anti-polish ring, it is necessary to reduce the diameter of the top land portion of the piston. In this case, the volume between a small diameter portion of the top land portion and the inner periphery of the cylinder liner (dead volume) during the descent of the piston becomes large. Thus, a compression ratio significantly varies in this section of the dead volume during the descent of the piston. Therefore, problems such as reduction in output due to the abrupt decrease of combustion pressure, increase in hydrocarbon, and the like can occur.

(2) An intake and exhaust valve on the side of the combustion chamber is generally designed so as to avoid the anti-polish ring. Accordingly, when the amount of protrusion of the anti-polish ring is increased, the diameter of the valve is reduced in inverse proportion, and hence the intake and exhaust efficiency becomes worse.

(3) When the amount of protrusion of the anti-polish ring is increased, it is necessary to also increase the thickness of the anti-polish ring. In this case, however, dimensional deformation in accordance with thermal expansion is also increased. Therefore, it becomes difficult to control the piston clearance.

In a structure according to the patent document 2, since the ring is positioned above the top dead center of the piston, the volume of the combustion chamber is increased, and hence variation in the compression ratio reduces the output. Ring grooves are positioned below the top end of the cylinder, so that it is difficult to insert the piston in assembly. Furthermore, there are problems that the oil and fuel tend to accumulate in a side clearance portion of the ring, carbon generates with increase in temperature in the vicinity of the top dead center, and the like. Thus, there is a problem of practicality.

It is also possible to apply a ring that has the same function as the anti-polish ring to a gasoline engine. A cylinder liner of the gasoline engine is pounded into a cylinder without being latched on an upper side of the cylinder. Accordingly, in the case of the gasoline engine, if the ring having the same diameter as the external diameter of the cylinder liner is disposed on an upper side and is clamped together by a cylinder head, there is a possibility that the cylinder liner is pressed by the ring to drop off from the cylinder liner.

The present invention aims to solve the problems associated with the foregoing conventional techniques. An object of the present invention is to further reduce the amount of oil ascending into a combustion chamber in an internal combustion engine that has a liner installation ring for forming a circular projection in a cylinder.

Another object of the present invention is to prevent a cylinder liner from dropping off during the fixation of the liner installation ring.

Means to Solve Problems

An internal combustion engine according to a first invention includes: a cylinder block having one or more cylinders; a tubular cylinder liner disposed inside the cylinder; a piston reciprocating inside the cylinder liner; and a liner installation ring. The outer periphery of the piston between a piston head and an uppermost ring groove forms a top land portion. The liner installation ring is disposed in the cylinder block or the cylinder liner in such a manner as to form a circular step portion inside the cylinder that protrudes toward the inner periphery of the cylinder liner. The bottom face of the liner installation ring face to an uppermost portion of the cylinder liner. The liner installation ring is disposed at a position in accordance with a top end position of the top land portion when the piston reaches a top dead center. A length of protrusion of the liner installation ring from the inner periphery of the cylinder liner in an inward direction is set to be from 0.05 mm or more to 0.5 mm or less.

According to the first invention, since the amount of protrusion of the liner installation ring is set to 0.05 mm or more, the liner installation ring can prevent oil from ascending into a combustion chamber. Meanwhile, the liner installation ring is disposed in accordance with the top end position of the piston top land portion when the piston reaches the top dead center, and the amount of protrusion of the liner installation ring is set to 0.5 mm or less. Thus, it is possible to suppress a harmful effect to a minimum due to an increase in the amount of protrusion of the liner installation ring.

A second invention is characterized in that according to the first invention a circular projection is formed on the bottom face of the liner installation ring in an inner peripheral end thereof, and a groove portion is formed below the circular step portion, sandwiched between the inner periphery of the cylinder liner and the projection. This structure allows the oil raised during the ascent of the piston to escape into the foregoing groove portion, so that it is possible to further suppress the ascent of the oil into the combustion chamber.

A third invention is characterized in that according to the foregoing second invention the projection has a tapered shape that downwardly inclines to the inside of the cylinder from a crosspoint of the bottom face of the liner installation ring and the inner periphery of the cylinder liner, and an angle that the tapered surface of the projection forms with the inner periphery of the cylinder liner is in a range of 45 degrees to 60 degrees. This enables a further reduction in the ascent of the oil into the combustion chamber.

A fourth invention is characterized in that in the foregoing first invention a circular notch is formed on an internal diameter side of a contact face of the cylinder block or the cylinder liner with the liner installation ring, and a groove portion is formed below the circular step portion, sandwiched between the bottom face of the liner installation ring and the notch. This structure enables the oil raised during the ascent of the piston to escape into the foregoing groove portion, so that it is possible to further reduce the ascent of the oil into the combustion chamber.

A fifth invention is characterized in that according to the foregoing fourth invention the notch is formed in a tapered shape, downwardly inclining from the contact face with the liner installation ring to the internal diameter side, and an angle that the bottom face of the liner installation ring forms with the tapered surface of the notch is in a range of 45 degree to 60 degree. This can further suppress the ascent of the oil into the combustion chamber.

A sixth invention is characterized in that according to any of the foregoing first to fifth inventions, the external diameter of the liner installation ring is set to be larger than that of an uppermost portion of the cylinder liner, and a latch step portion is formed in the upper portion of the cylinder of the cylinder block and latches the liner installation ring to restrain its downward movement. This structure can restrain the downward movement of the liner installation ring.

A seventh invention is characterized in that according to the foregoing sixth invention, the uppermost portion of the cylinder liner is positioned above the uppermost ring groove when the piston reaches the top dead center, and it is disposed below the latch step portion with a distance. In this structure, the cylinder liner is not pressed by the liner installation ring.

An eighth invention is characterized in that according to any of the foregoing first to seventh inventions the linear installation ring has open parts at a position in a peripheral direction which face to each other with a predetermined distance, in order to fix the linear installation ring on the cylinder block or the cylinder liner by tension of the open parts separating from each other.

A ninth invention is characterized in that according to any of the foregoing first to eighth inventions, a ring-side circular groove is formed in the inner periphery of the liner installation ring in the peripheral direction of the ring. By this structure, the oil raised during the ascent of the piston can escape into the ring-side circular groove, thereby suppressing the ascent of the oil into the combustion chamber.

A tenth invention is characterized in that according to any of the foregoing first to ninth inventions, a piston-side circular groove is formed in the top land portion of the piston in the peripheral direction of the piston. According to this structure, the oil raised during the ascent of the piston escapes into the piston-side circular groove, thereby suppressing the ascent of the oil into the combustion chamber.

An eleventh invention is characterized in that according to any of the foregoing first to eighth inventions, a ring-side circular groove is formed in the inner periphery of the liner installation ring in the peripheral direction of the ring, and a piston-side circular groove is formed in the top land portion of the piston in the peripheral direction of the piston in such a position to face to the ring-side circular groove when the piston reaches the top dead center. According to this structure, the oil escapes into the ring-side circular groove and the piston-side circular groove, so that it is possible to suppress the ascent of the oil into the combustion chamber. Especially, when the piston is in the vicinity of the top dead center, the ring-side circular groove face to the piston-side circular groove, which increases a trapping effect of changing a destination of a flow of gas from the combustion chamber to a crank chamber.

A twelfth invention is characterized in that according to any of the foregoing first to eleventh inventions, a piston-side circular groove is also formed in a second land portion in the peripheral direction of the piston. The second land portion is positioned below the top land portion of the piston and the uppermost ring groove. According to this structure, the oil raised during the ascent of the piston escapes into the piston-side circular groove, thereby suppressing the ascent of the oil into the combustion chamber.

A thirteenth invention is characterized in that according to any of the foregoing ninth to twelfth inventions, a longitudinal section of at least one of the ring-side circular groove and the piston-side circular groove is V-shaped such that the top face thereof is horizontal or upwardly inclines to the bottom of the groove, and the bottom face thereof is tapered in such a manner that it goes away from the bottom of the groove as it goes downward. According to this structure, it is easy to get out the oil to the foregoing circular groove, increasing the trapping effect of changing the destination of the flow of gas from the combustion chamber to the crank chamber and thereby further suppressing the ascent of the oil into the combustion chamber. The piston-side circular groove according to the thirteenth invention includes both of the piston-side circular grooves formed in the top land portion and the second land portion of the piston.

A fourteenth invention relates to a liner installation ring to be applied to an internal combustion engine that includes a cylinder block having one or more cylinders with a latch step portion in its/their upper portion(s) and a tubular cylinder liner disposed in the cylinder. The liner installation ring is disposed in the latch step portion with its bottom face facing to an uppermost portion of the cylinder liner. When the liner installation ring is disposed, an inner peripheral end of the ring inwardly protrudes from the inner periphery of the cylinder liner to the cylinder to form a circular step portion inside the cylinder. A length from a position of the inner periphery of the cylinder liner when the liner installation ring is disposed to the inner peripheral end of the disposed ring is set to be in a range of 0.05 mm to 0.5 mm.

A fifteenth invention is characterized in that according to the foregoing fourteenth invention, a circular projection is provided in the bottom face along the inner peripheral end of the ring, the projection is formed in a tapered shape such that it downwardly inclines toward the inner periphery of the ring from a position of the inner periphery of the cylinder liner when the ring is disposed, and an angle that the tapered surface of the projection forms with the inner periphery of the cylinder liner is in a range of 45 degrees to 60 degrees.

A sixteenth invention is characterized in that according to the foregoing fourteenth or fifteenth invention the linear installation ring has open parts at a position in a peripheral direction of the ring, the open parts facing to each other with a predetermined distance.

A seventeenth invention is characterized in that according to the foregoing fourteenth or fifteenth invention, the liner installation ring has a ring-side circular groove in the inner periphery in a peripheral direction of the ring.

An eighteenth invention is characterized in that according to the foregoing seventeenth invention, a longitudinal section of the ring-side circular groove is V-shaped such that the top face of the ring-side circular groove is horizontal or upwardly inclines to the bottom of the groove, and the bottom face thereof is tapered in such a manner that it goes away from the bottom of the groove as it goes downward.

Advantages Effect of the Invention

According to the present invention, the liner installation ring can suppress the ascent of the oil into the combustion chamber. In particular, with the groove portion formed below the circular step portion formed by the liner installation ring, or with the ring-side circular groove facing to the piston-side circular groove, the suppression effect will be more remarkable.

According to the present invention, the liner installation ring is fixed on the latch step portion and does not press the cylinder liner. Thus, the cylinder liner will not drop off if a cylinder head clamps the liner installation ring together with the cylinder block.

BRIEF DESCRIPTION OF THE DRAWINGS

The nature, principle, and utility of the invention will become more apparent from the following detailed description when read in conjunction with the accompanying drawings in which like parts are designated by identical reference numbers, in which.

BEST MODE FOR CARRYING OUT THE INVENTION

Embodiments of the present invention will be hereinafter described in detail with reference to the drawings.

The Structure of a First Embodiment

Figure 1:
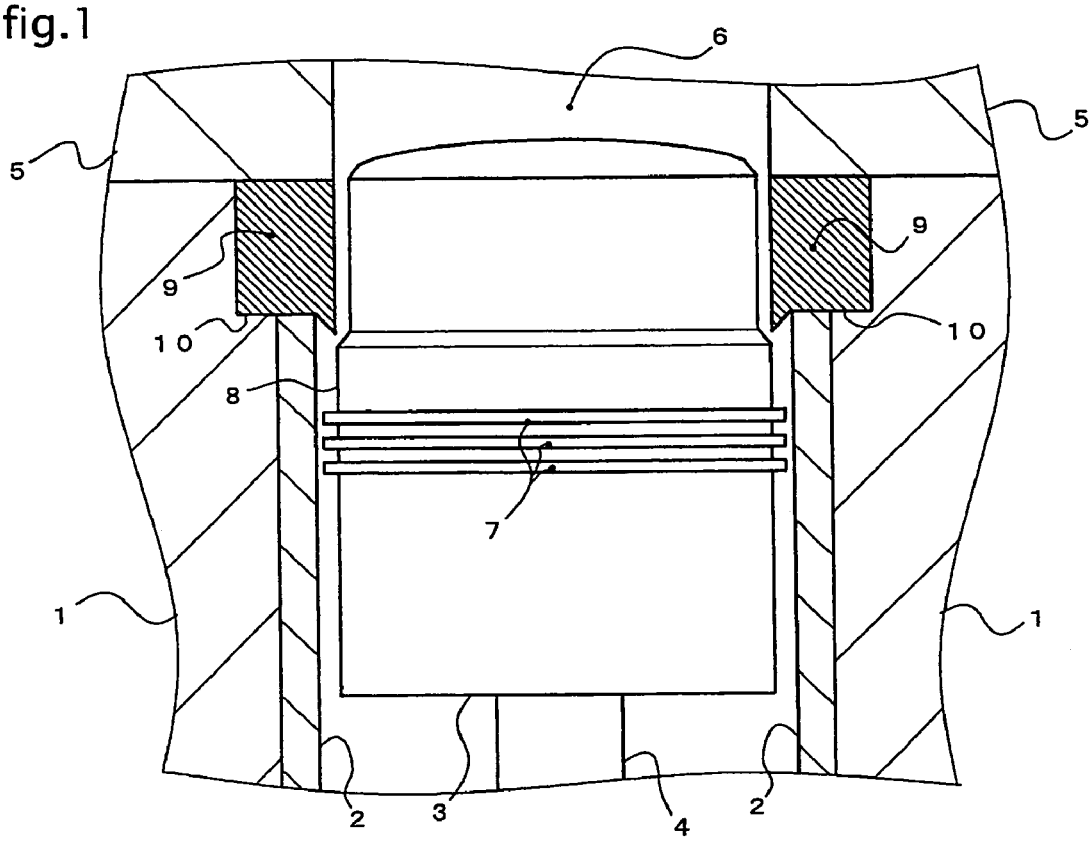
[FIG. 1] a longitudinal sectional view of a cylinder section of an internal combustion engine according to a first embodiment.
Figure 2:
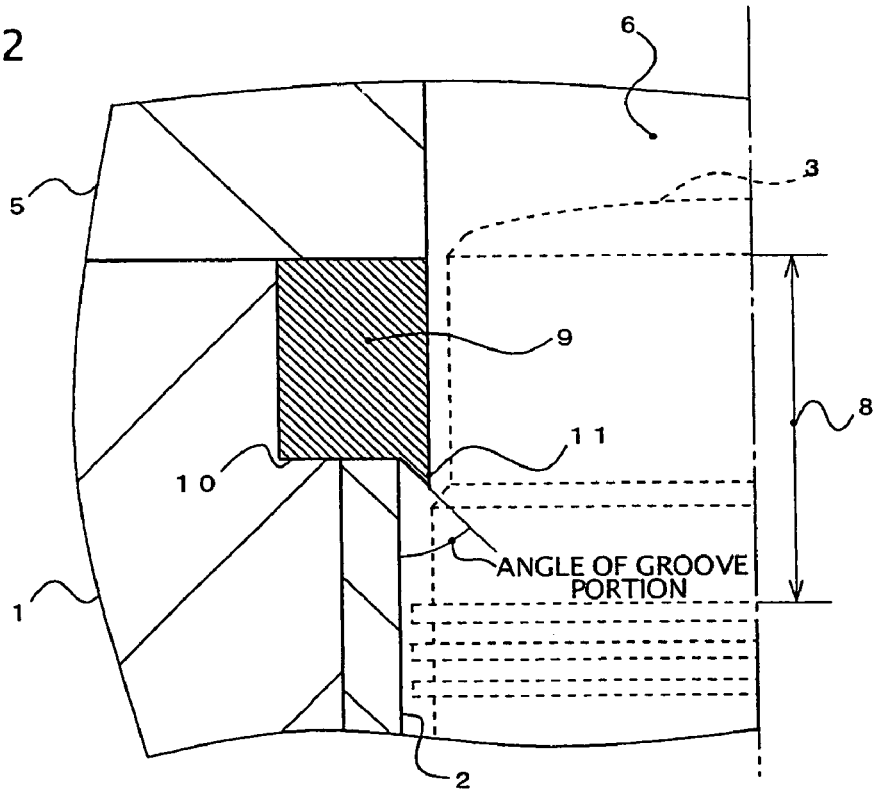
[FIG. 2] a partial enlarged view of FIG. 1.

FIGS. 1 and 2 are longitudinal sectional views of a cylinder section of an internal combustion engine according to a first embodiment. Briefly describing the whole structure of the internal combustion engine according to the first embodiment, a tubular cylinder liner 2 is fitted into a cylinder formed in a cylinder block 1. Inside the cylinder liner 2, a piston 3 reciprocating in the axial direction of the cylinder liner 2 is disposed. The piston 3 is coupled to a crank shaft (not illustrated) through a connecting rod 4. The reciprocating motion of the piston 3 is converted into the rotational motion of the crank shaft. A cylinder head 5 is fixed on the top of the cylinder block 1 with stud bolts (not illustrated). A closed space surrounded by the cylinder liner 2, the piston 3, and the cylinder head 5 composes a combustion chamber 6.

A plurality of ring grooves is formed in the outer periphery of the piston 3. The outer periphery of the piston 3 that is vertically partitioned by each ring groove is called a land. Piston rings 7 (compression ring and oil ring) are fitted into these ring grooves. An upper end portion of the outer periphery (a top land portion 8) that is sandwiched between a piston head and the uppermost ring groove, and the piston head are processed so as to have slightly little diameters than the lower side of the piston 3. Thus, the upper end portion of the top land portion 8 and the piston head do not interfere with an internal diameter portion of a liner installation ring 9 described later.

In the internal combustion engine according to the first embodiment, an upper end portion of the cylinder in the cylinder block 1 is notched concentrically with the cylinder to form a latch step portion 10. The liner installation ring 9 is disposed in the latch step portion 10. The position where the liner installation ring 9 is disposed corresponds to the position of the upper end of the top land portion 8 when the piston 3 reaches a top dead center. In the first embodiment, an uppermost portion of the cylinder liner 2 is positioned at the height of the latch step portion 10. The bottom face of the liner installation ring 9 oppositely makes contact with the uppermost portion of the cylinder liner 2.

The external diameter of the liner installation ring 9 is equal to or larger than the external diameter of the uppermost portion of the cylinder liner 2. Thus, when the cylinder head 5 clamps the liner installation ring 9 together with the cylinder block, the latch step portion 10 restrains the downward movement of the liner installation ring 9. Therefore, the liner installation ring 9 does not press the cylinder liner 2 to drop off.

The internal diameter of the liner installation ring 9, on the other hand, is set smaller than the internal diameter of the uppermost portion of the cylinder liner 2. Thus, the inner periphery of the liner installation ring 9 protrudes from the inner periphery of the cylinder liner 2 toward the inside of the cylinder. This protruding portion forms a circular step portion inside the cylinder.

The length of protrusion (the amount of protrusion) of the liner installation ring 9 from the inner periphery of the cylinder liner 2 in an inward direction is set in a range of from 0.05 mm to 0.5 mm. The amount of protrusion of the liner installation ring 9 is set to 0.05 mm or more because oil consumption abruptly increases due to the ascent of oil to the combustion chamber 6 when the amount of protrusion is less than 0.05 mm. The amount of protrusion is set to 0.5 mm or less because protrusion of 0.5 mm or more cause large harmful effects such as decrease in intake and exhaust efficiency due to variation in a compression ratio by increase in dead volume and to reduction in the diameter of an intake and exhaust valve, or difficult piston clearance control. With the amount of protrusion in the range of from 0.05 mm to 0.5 mm, it is expectable of practically sufficient effect of suppressing the ascent of the oil. It is more preferable that the amount of protrusion be in the range of from 0.1 mm to 0.4 mm.

Figure 3:
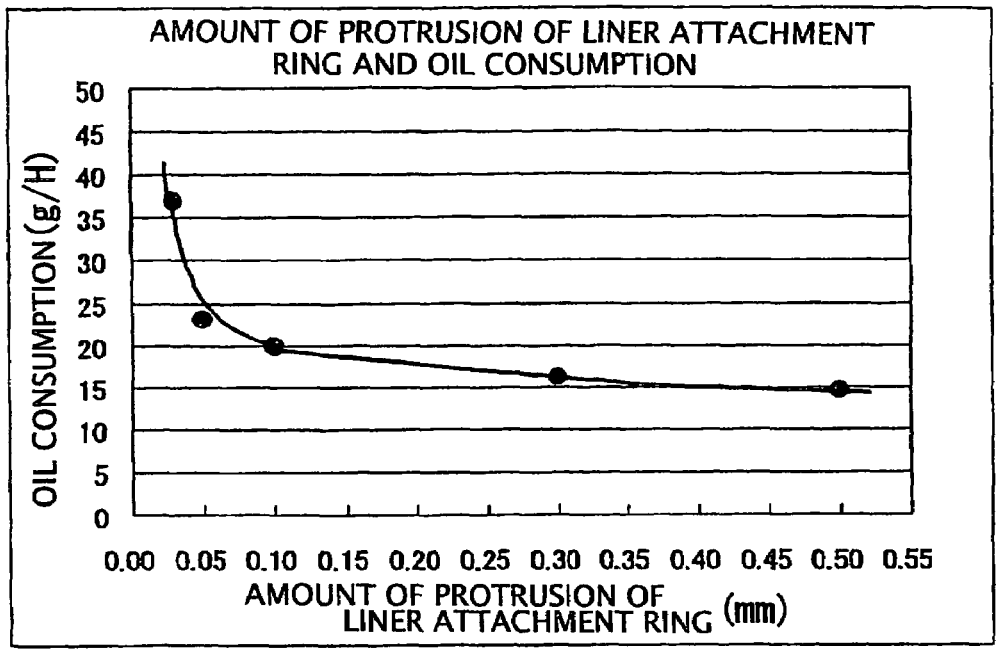
[FIG. 3] a graph showing experiment results about the relation between the amount of protrusion of a liner installation ring and oil consumption.

FIG. 3 shows experiment results about the relation between the amount of protrusion of the liner installation ring and the oil consumption. A water-cooled four-cylinder 1.8 L gasoline engine was used in the experiment. After the latch step portion was processed in the cylinder block made of aluminum, the cast-iron liner installation ring was disposed in the latch step portion by transition fit, and the oil consumption per hour was measured. Measurements were carried out for five different protrusions of the liner installation ring, that is, 0.03 mm, 0.05 mm, 0.1 mm, 0.3 mm, and 0.5 mm. In this experiment, a projection was not formed in the bottom face of the liner installation ring. The other conditions are shown in the table 1.

TABLE 1

| | |
|---|---|
| SAMPLE ENGINE | WATER-COOLED FOUR-CYLINDER 1.8 L ENGINE |
| VISCOSITY OF OIL | 5W-20, SJ GRADE |
| TEMPERATURE OF OIL | 90° C. |
| NUMBER OF REVOLUTIONS | 6000 rpm |

As shown in FIG. 3, when the amount of protrusion of the liner installation ring is 0.03 mm, the oil consumption per hour is 35 g or more. In the range of from 0.05 mm to 0.5 mm, on the other hand, the oil consumption is reduced from approximately 15 g to 25 g or less. It is assumed that the oil consumption is further reduced with increase in the amount of protrusion, but increase in the dead volume and the like also makes a larger effect. Thus, the substantial upper limit of the amount of protrusion is 0.5 mm or less.

A circular projection 11 is formed in the bottom face of the liner installation ring 9 according to the first embodiment along an inner peripheral end of the liner installation ring 9. The projection 11 is downwardly tapered from the corresponding position of the inner periphery of the cylinder liner 2 in the inward direction of the cylinder. When the liner installation ring 9 is disposed in the latch step portion 10, a groove portion sandwiched between the inner periphery of the cylinder liner 2 and the projection 11 of the liner installation ring 9 is downwardly formed under a circular step portion by the liner installation ring 9. The groove portion under the circular step portion is formed in the shape of a triangle in cross section. An angle which the tapered surface of the projection 11 forms with the inner periphery of the cylinder liner (the angle of the groove portion) is set in a range of from 45 degrees to 60 degrees.

Figure 4:
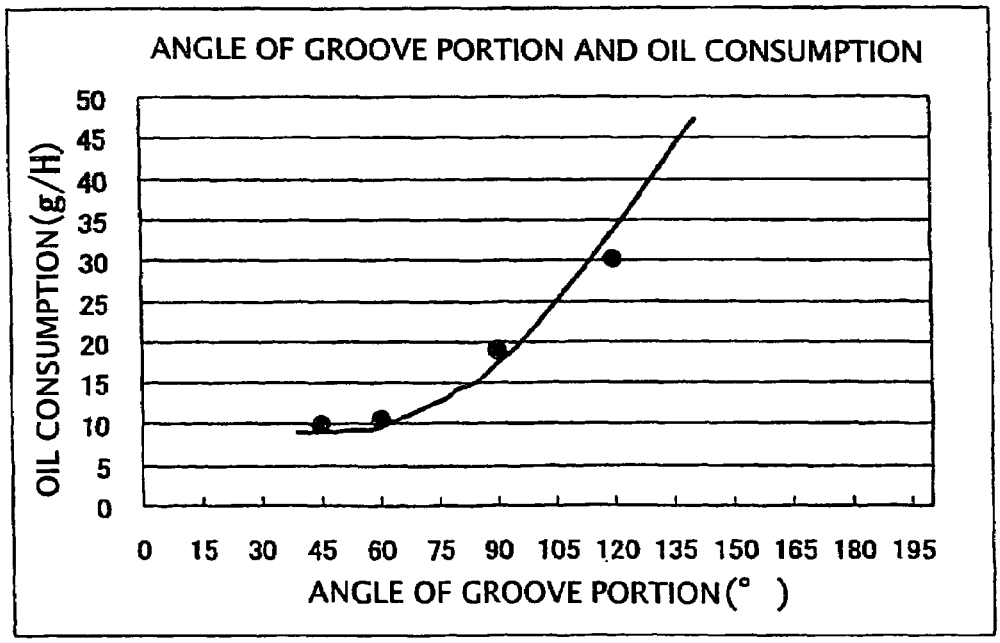
[FIG. 4] a graph showing experiment results about an angle of a groove portion in the bottom face of the liner installation ring and oil consumption.

FIG. 4 shows experiment results about the relation between the angle of the groove portion in the bottom face of the liner installation ring and the oil consumption. In the foregoing experimental equipment on the amount of protrusion of the liner installation ring, the angle of the projection was varied in the liner installation ring the protruding amount of which was 0.3 mm. The oil consumption per hour was measured in each angle in this experiment. Measurements were carried out on the four angles of the groove portion, that is, 45 degrees, 60 degrees, 90 degrees (a case where there is no projection), and 120 degrees (a case where the bottom face of the liner installation ring forms an upward tapered surface).

As shown in FIG. 4, when the projection is formed in the bottom face of the liner installation ring and the groove portion of 60 degrees or less is provided, the oil consumption is desirably reduced (approximately 10 g/h) by one-half of that in the case without the projection (approximately 20 g/h). When the bottom face of the ring forms the upward tapered surface, the oil consumption is increased (approximately 30 g/h).

When the angle of the groove portion is set smaller than 45 degrees, the circulation of the oil becomes worse, because the volume of the groove portion is reduced. There is a possibility that carbon tends to accumulate in the groove portion. Thus, in this case, it is assumed that an effect is reduced with time, so that it is preferable that the angle of the groove portion be set at 45 degrees or more.

Figure 5:
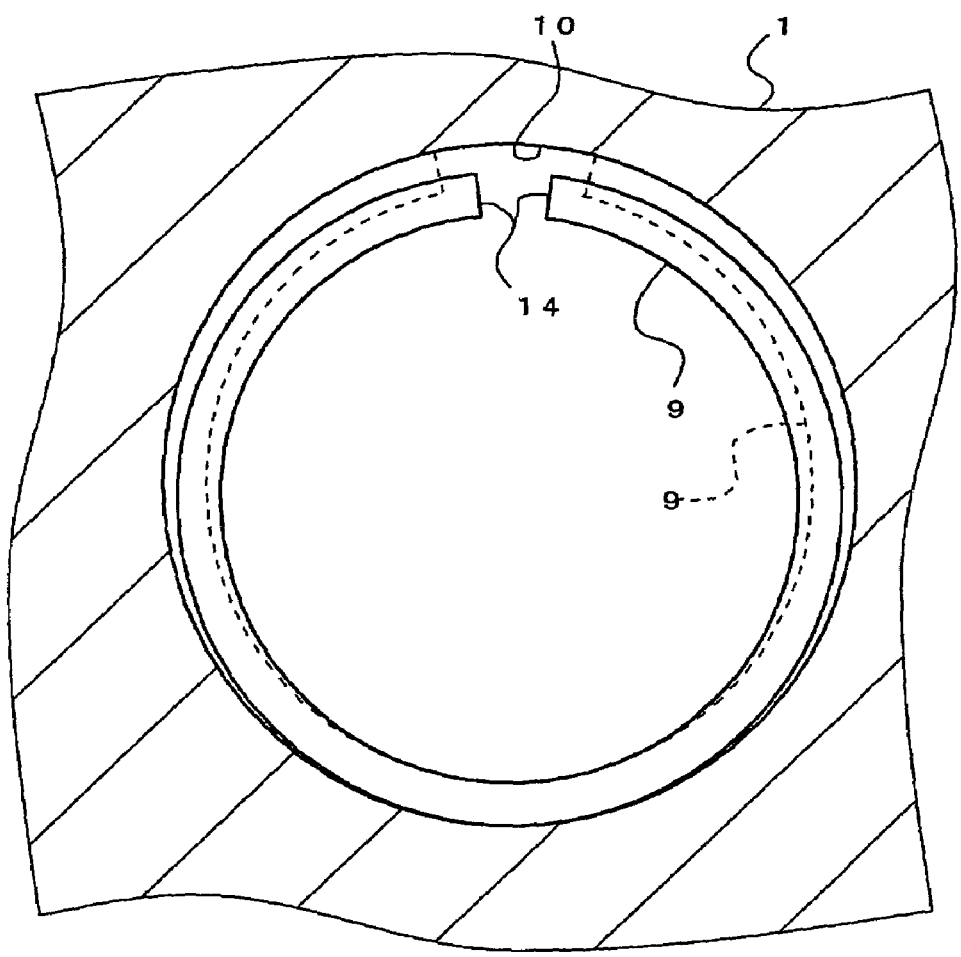
[FIG. 5] a plan view showing an open part of the liner installation ring.

In the first embodiment, as shown in FIG. 5, open parts 14 may be formed in one position of the liner installation ring 9 in the peripheral direction of the ring. The open parts 14 of the liner installation ring 9 face to each other at a predetermined distance. In this case, as shown by broken lines in FIG. 5, the liner installation ring 9 is fixed in such a manner as to be pressed against the outer periphery of the latch step portion 10, by the tension of the open parts 14 separating from each other. Therefore, it is possible to facilitate an assembly operation and a disassembly operation.

It is preferable that the liner installation ring 9 be made of a material the thermal expansion coefficient of which is larger than that of a material of the cylinder block 1 (or the cylinder liner 2), though it is not especially limited. In such a case, the liner installation ring 9 is tightly fixed on the latch step portion 10 by thermal expansion, so that it is possible to prevent fretting wear due to a wobble in the liner installation ring 9. At normal temperature, on the other hand, a relatively large clearance is formed between the external diameter of the liner installation ring 9 and the internal diameter of the latch step portion 10, so that it is possible to ease an assembly operation and a disassembly operation. To be more specific, a combination of an FC liner and an aluminum liner installation ring is preferable, because the thermal expansion coefficient of the ring is approximately twice as large as that of a material of the cylinder. As a matter of course, the foregoing combination is just an example, and a combination is not limited thereto.

The Function of the First Embodiment

The internal combustion engine according to the first embodiment is structured as described above. The function of the internal combustion engine will be hereinafter described.

First, in the internal combustion engine according to the first embodiment, the oil is stored in a space defined by the cylinder liner 2, the top land portion 8 of the piston 3, and the uppermost piston ring 7 during operation. The position of the space, in which the oil is stored, moves upward and downward with the reciprocating motion of the piston 3. When the piston 3 reaches the top dead center, an upward inertial force acting on the oil becomes largest.

In the first embodiment, the liner installation ring 9 protrudes toward the inner periphery of the cylinder liner 2, while it is disposed in such a position as to correspond to the upper end position of the top land portion 8 at the piston top dead center. Thus, the oil upwardly raised by the piston ring 7 collides against the bottom face of the circular step portion of the liner installation ring 9. Therefore, since the oil is prevented from being raised into the combustion chamber 6, it is possible to prevent the scattering of the oil into the combustion chamber 6.

Particularly in the first embodiment, the groove portion in the shape of the triangle in cross section is downwardly formed by the projection 11 in the bottom face of the circular step portion. Thus, since the oil raised by the piston ring 7 is blocked by the tapered shaped projection 11, the oil is likely to be accumulated in the groove portion. Accordingly, the amount of the oil raised into the combustion chamber 6 is reduced. Incidentally, the oil in the groove portion returns downward by gravity.

In the internal combustion engine according to the first embodiment, the bottom face of the liner installation ring 9 makes contact with the uppermost portion of the cylinder liner 2. The downward movement of the liner installation ring 9, however, is restrained by the latch step portion 10. Accordingly, when the liner installation ring 9 is clamped by the cylinder head 5 together with the cylinder block, the liner installation ring 9 does not press the cylinder liner 2 to drop off.

The Structure and Function of a Second Embodiment

Figure 6:
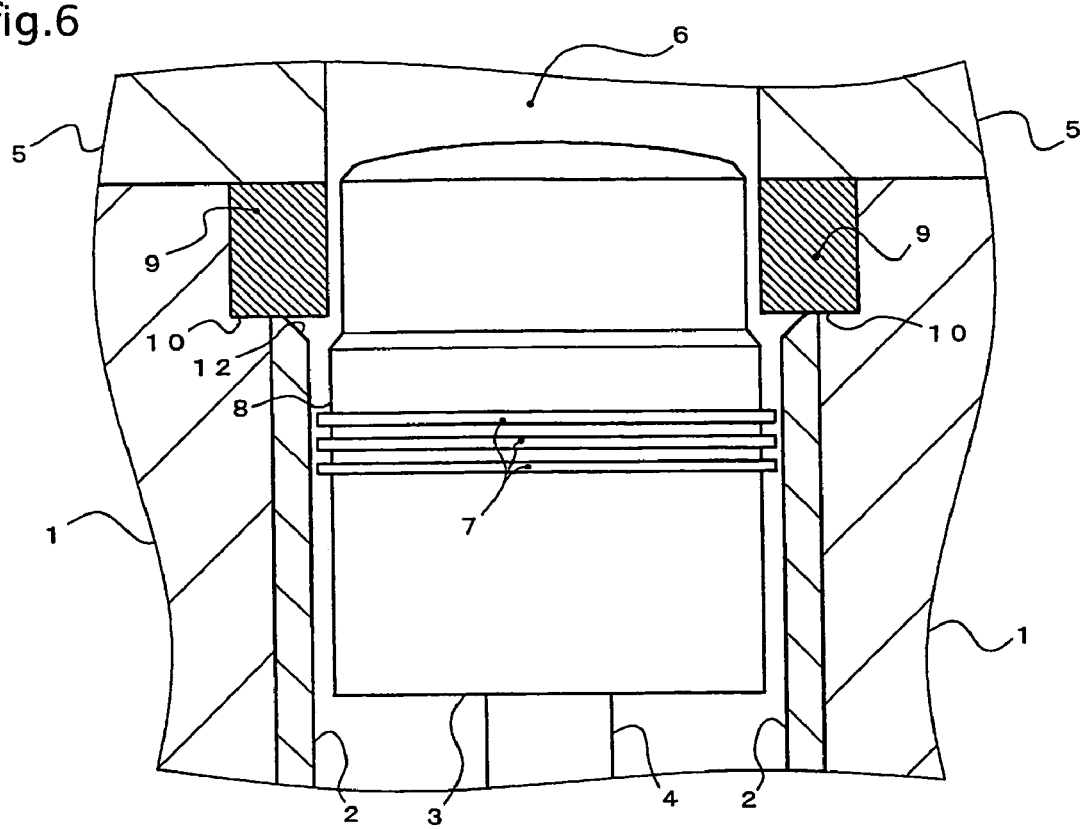
[FIG. 6] a longitudinal sectional view of a cylinder section of an internal combustion engine according to a second embodiment.
Figure 7:
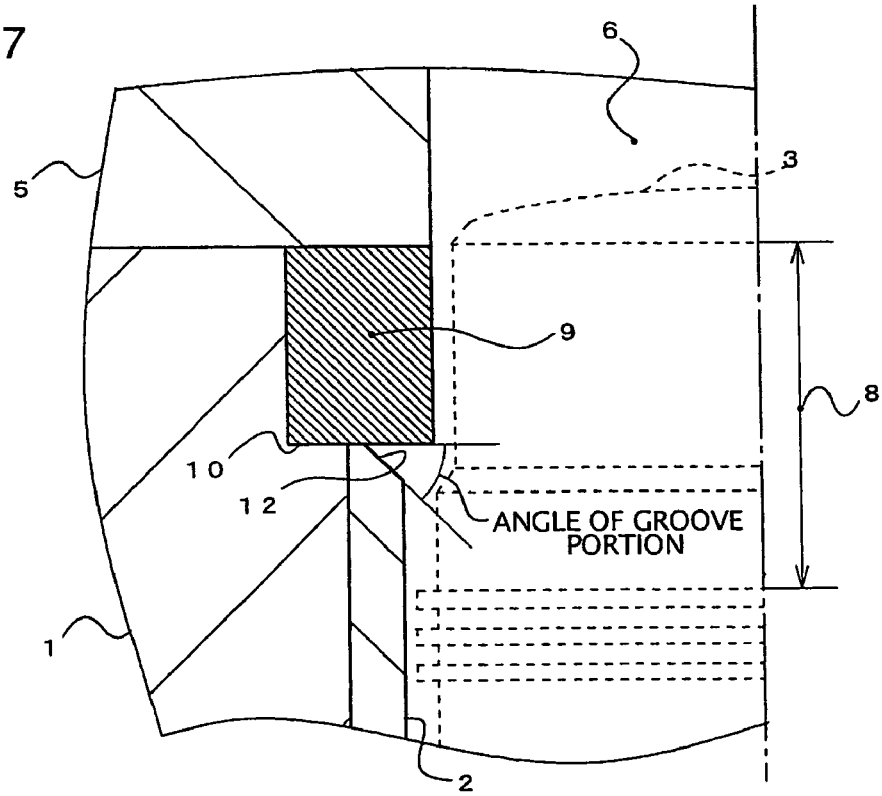
[FIG. 7] a partial enlarged view of FIG. 6.

FIGS. 6 and 7 are longitudinal sectional views of a cylinder section of an internal combustion engine according to a second embodiment. In the following embodiment, the same reference numbers as those of the first embodiment refer to the same structure as the first embodiment, and description thereof will be omitted. Only differences with the first embodiment will be described.

In the second embodiment, a groove portion is formed by processing a cylinder liner 2, instead of providing a projection in a liner installation ring 9. In the second embodiment, an internal diameter portion of an uppermost portion of the cylinder liner 2 is cut into a tapered shape, which is downwardly inclined from the uppermost portion of the cylinder liner 2 (contact surface with the liner installation ring 9) toward an internal diameter side, to form a circular notch 12.

When the internal combustion engine is assembled, a groove portion in the shape of a triangle in cross section is formed between the tapered surface of the notch 12 and the bottom face of the liner installation ring 9. It is preferable that an angle which the bottom face of the liner installation ring 9 forms with the tapered surface of the notch 12 (an angle of the groove portion) be set in a range of from 45 degrees to 60 degrees.

The function of the second embodiment will be described. Since oil raised by a piston ring 7 collides against the bottom face of a circular step portion formed by the liner installation ring 9, the oil is blocked from being raised into a combustion chamber. Part of the oil is accumulated in the groove portion and escapes, so that the amount of oil raised into the combustion chamber is reduced. Incidentally, the oil accumulated in the groove goes down, guided by the tapered surface of the notch 12. Therefore, the structure of the second embodiment can provide approximately the same effects as the first embodiment.

The Structure and Function of a Third Embodiment

Figure 8:
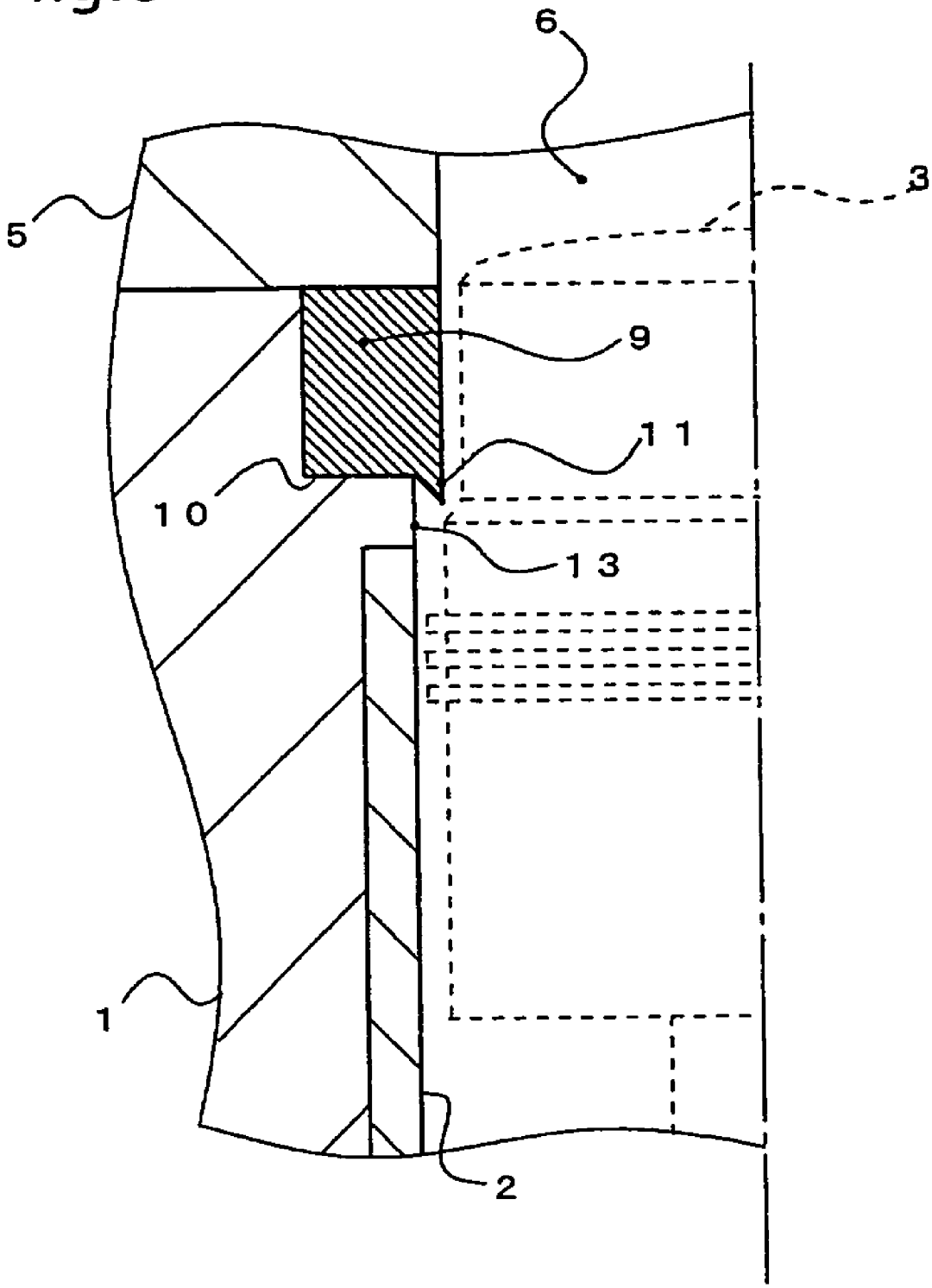
[FIG. 8] a longitudinal sectional view of a cylinder section of an internal combustion engine according to a third embodiment.

FIG. 8 is a longitudinal sectional view of a cylinder section of an internal combustion engine according to a third embodiment. The third embodiment has such a structure that the bottom face of a liner installation ring 9 is apart from an uppermost portion of a cylinder liner 2. In other words, the bottom face of the liner installation ring 9 only makes contact with a latch step portion 10 of a cylinder block 1. The uppermost portion of the cylinder liner 2 is disposed downward beyond a projection 13 of the cylinder block 1. The projection 13 of the cylinder block 1 projects to the position of the inner periphery of the cylinder liner 2. The cylinder liner 2 according to the third embodiment is so disposed that the uppermost portion of the cylinder liner 2 is positioned above an uppermost ring groove of a piston in a top dead center.

The function of the third embodiment will be described. When the liner installation ring 9 is clamped by a cylinder head 5 together with the cylinder block, the liner installation ring 9 is apart from the cylinder liner 2 at the projection 13 away. Thus, the cylinder liner does not drop off by being pressed.

The Structure and Function of a Fourth Embodiment

Figure 9:
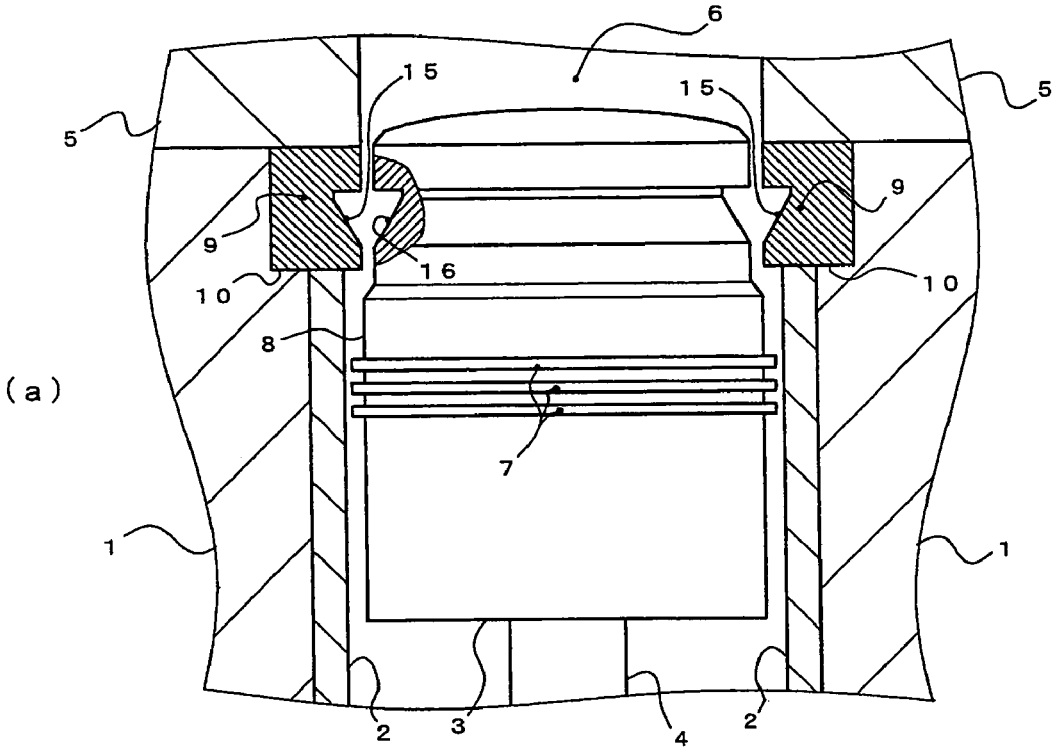
[FIG. 9] a longitudinal sectional view of a cylinder section of an internal combustion engine according to a fourth embodiment.
Figure 9:
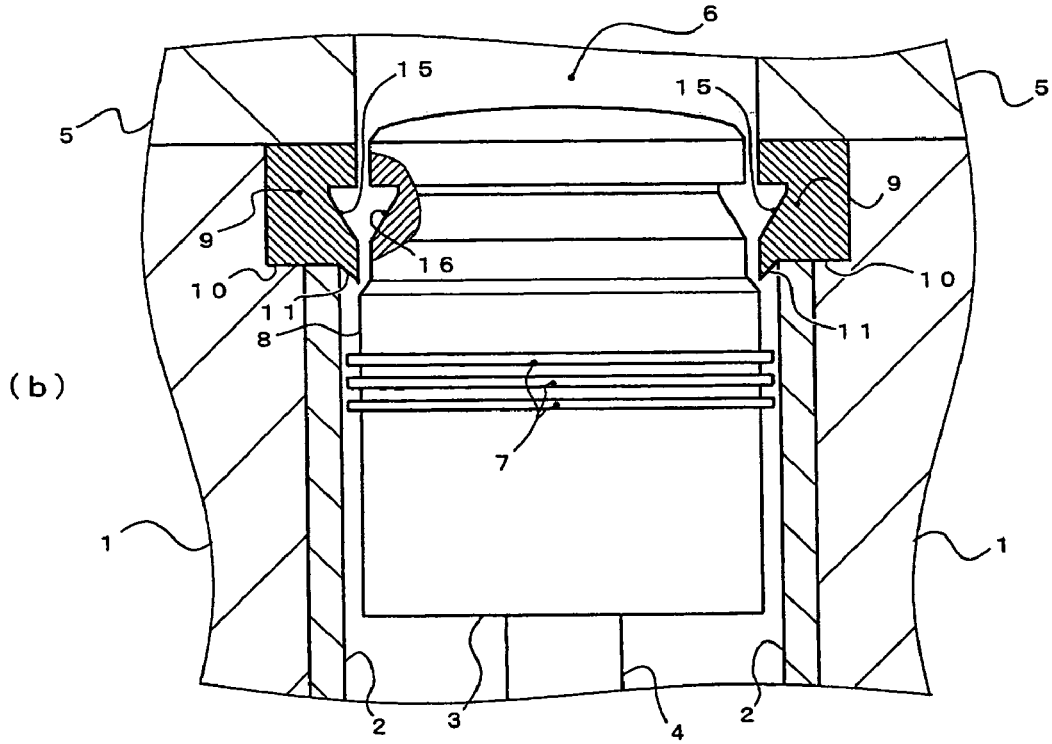

FIG. 9 is a longitudinal sectional view of a cylinder section of an internal combustion engine according to a fourth embodiment.

In the fourth embodiment, a ring-side circular groove 15 is formed in the inner periphery of a liner installation ring 9 along the peripheral direction of the ring. In addition, a piston-side circular groove 16 is formed in a top land portion 8 of a piston 3 along the peripheral direction of the piston. The piston-side circular groove 16 is set to a position opposite to the ring-shaped circular groove 15 when the piston 3 reaches a top dead center. The ring-side circular groove 15 and the piston-side circular groove 16 are in the shape of V in longitudinal cross section. The upper faces of the circular grooves are horizontally or upwardly inclined from the inner periphery of the ring to the bottoms of the grooves. The lower faces of the circular grooves are downwardly tapered with being apart and extended from the bottoms of the grooves. It is preferable that the inclination of the lower faces of the ring-side circular groove 15 and the piston-side circular groove 16 with respect to the axis of a piston be 15 to 45 degrees, from the viewpoint of further increasing the effect of restraining the ascent of oil, and a trapping effect, which will be described later.

In the fourth embodiment, the oil raised during the ascent of the piston escapes into the ring-side circular groove 15 and the piston-side circular groove 16, so that the oil is prevented from being raised into a combustion chamber. Both of the ring-side circular groove 15 and the piston-side circular groove 16 are in the shape of V in cross section, and both of them are opposite to each other when the piston 3 reaches the top dead center. Accordingly, when the piston 3 reaches the vicinity of the top dead center, the trapping effect by which an upward flow of gas heading for the combustion chamber is changed into a downward flow of gas heading for a crank chamber is increased. Thus, it is possible to further prevent the oil from being raised into the combustion chamber. The oil that escapes and accumulates in the grooves returns downward by being guided by the tapered surfaces of the circular grooves.

As shown in FIG. 9B, the ring-side circular groove 15 and the piston-side circular groove 16 may be formed so as to be opposite to each other when the piston 3 reaches the top dead center, and a projection 11 may be formed in the bottom face of the liner installation ring 9. In this case, the synergistic effect of the ring-side circular groove 15 and the piston-side circular groove 16, and a groove portion sandwiched between the inner periphery of the cylinder liner 2 and the projection 11 of the liner installation ring 9 can significantly reduce oil consumption. Thus, it becomes possible to reduce the tension of a piston ring, or reduce one of compression rings.

Figure 10:
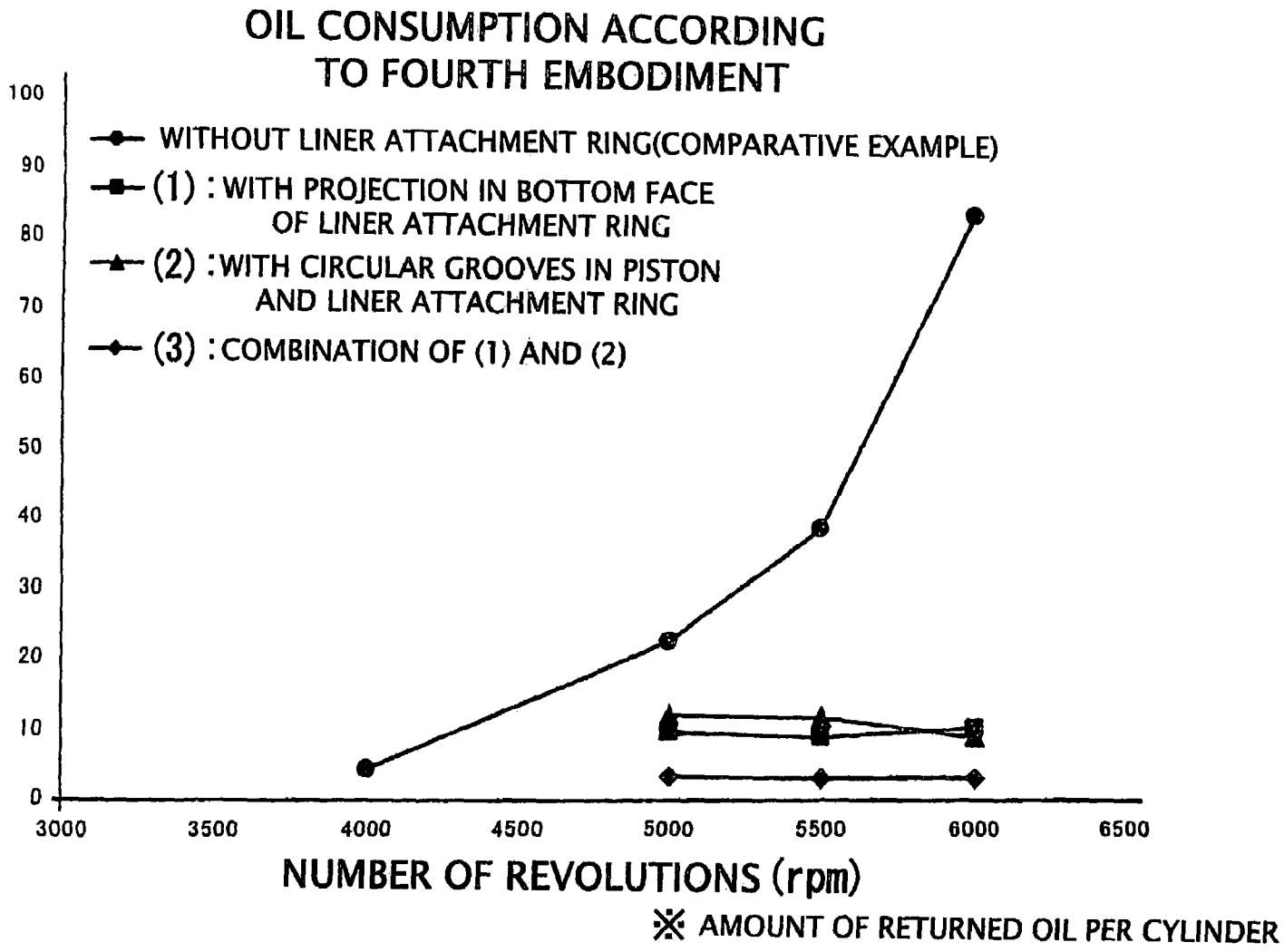
[FIG. 10] a graph showing experiment results related to oil consumption of the internal combustion engine according to the fourth embodiment.

FIG. 10 shows experiment results related to the oil consumption of the internal combustion engine according to the fourth embodiment. In an experiment, three types of combinations of the piston and the liner installation ring according the present invention were prepared in the foregoing experimental equipment according to the first embodiment. The oil consumption per hour was measured under conditions of 5000 rpm, 5500 rpm, and 6000 rpm. Oil consumption in a case where the liner installation ring was not attached was measured as a comparative example, and the oil consumption was compared with measurement results according to the present invention.

The experiment was carried out in the following three cases. (1) The liner installation ring that has the projection in the bottom face is attached, and the ring-side circular groove 15 and the piston-side circular groove 16 are not formed [the first embodiment]. (2) The circular grooves 15 and 16 in the shape of V in cross section are formed in the piston and the liner installation ring, respectively [refer to FIG. 9A]. (3) The foregoing (1) and (2) are combined [refer to FIG. 9B]. The amount of protrusion of the liner installation ring is 0.3 mm in either case. In (1) and (3), an angle of the groove portion (an angle which the tapered surface of the projection 11 forms with the inner periphery of the cylinder liner) is set to 50 degrees. In (2) and (3), the upper faces of the piston-side and ring-side circular grooves 15 and 16 are horizontal, and the inclination of the lower faces with respect to the axis of the piston is 30 degrees. The depth of the grooves from the surface of the piston in a radial direction is 1 mm (deepest portion), and the height of the grooves (the width in the axial direction of the piston) is 1.5 mm.

As shown in FIG. 10, the oil consumption in the case of (2) is approximately the same as the oil consumption in the case of (1), and the oil consumption is reduced by 50% to 90% with respect to the comparative example. Therefore, it is possible to obtain approximately the same effect as the foregoing first embodiment by a structure, in which the circular grooves 15 and 16 in the shape of V in cross section are formed in the piston and the liner installation ring, respectively.

When the foregoing (1) and (2) are combined, as in the case of (3), the oil consumption is reduced by 90% or more with respect to the comparative example, and is further reduced by approximately 70% with respect to each of the cases of (1) and (2). Therefore, it is possible to obtain the extremely large effect of restraining the oil consumption, when the circular grooves 15 and 16 in the shape of V in cross section are formed in the piston and the liner installation ring, respectively, and the groove portion is formed in the bottom face of the liner installation ring. Furthermore, the oil consumption significantly increases with increase in the number of revolutions in the comparative example of FIG. 10. In either of (1) to (3), however, the oil consumption is almost constant even if the number of revolutions is increased. Accordingly, it has turned out that the effect of restraining the oil consumption becomes significant particularly when the number of revolutions is high, in any case of the present invention.

Modification Examples of the Fourth Embodiment

Figure 11:
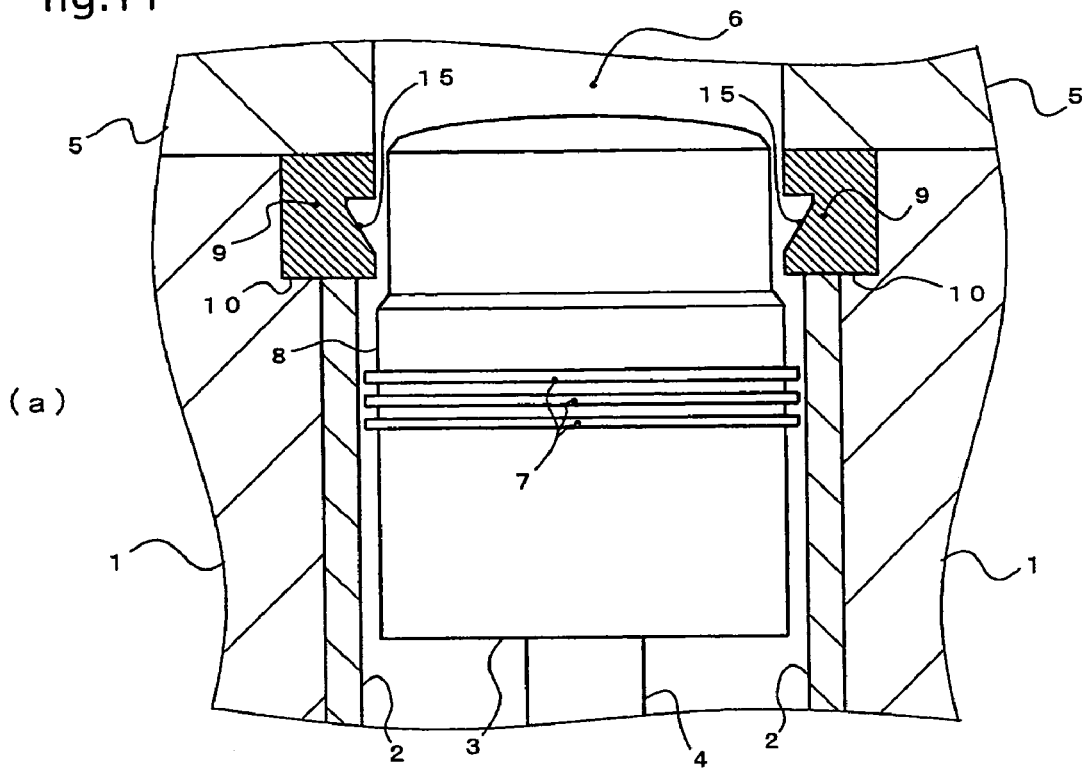
[FIG. 11] a diagram showing the structure of an internal combustion engine according to a modification example of the fourth embodiment.
Figure 11:
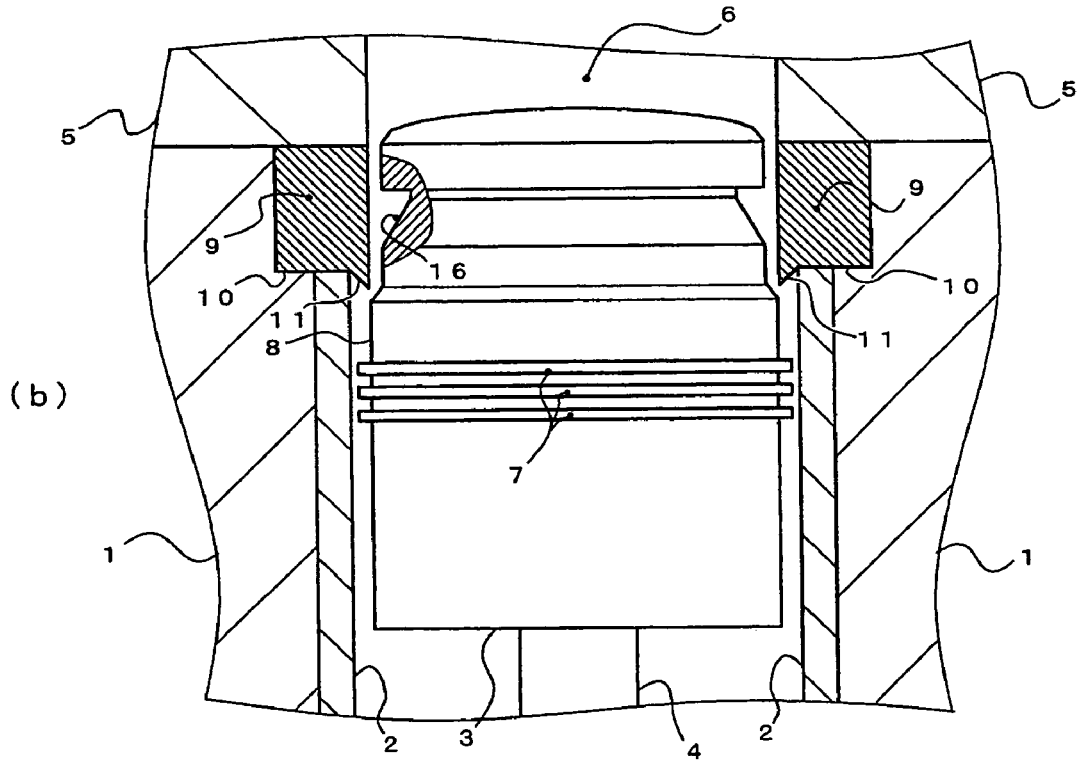
Figure 12:
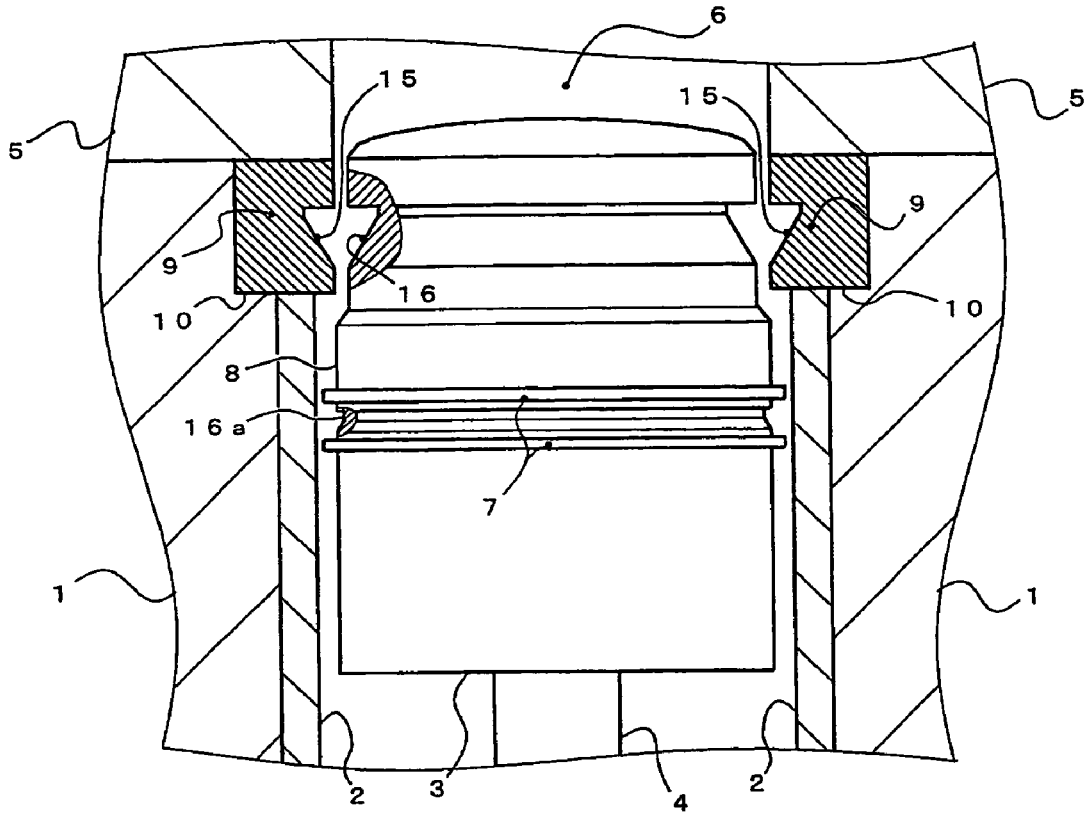
[FIG. 12] a diagram showing the structure of an internal combustion engine according to another modification example of the fourth embodiment.

FIGS. 11 and 12 show structures of internal combustion engines according to modification examples of the fourth embodiment. FIG. 11A shows a structure in which a ring-side circular groove 15 in the shape of V in cross section is formed in the inner periphery of a liner installation ring 9, and a circular groove is not formed in a piston 3. FIG. 11B shows a structure in which a piston-side circular groove 16 in the shape of V in cross section is formed in a top land portion 8 of a piston 3, and a circular groove is not formed in a liner installation ring 9. FIG. 12 shows a structure in which circular grooves 15 and 16 in the shape of V in cross section are formed in a top land portion 8 of a piston 3 and a liner installation ring 9, respectively. In addition, a piston-side circular groove 16*a* in the shape of V in cross section is formed in a second land portion of the piston 3. It is preferable that the inclination of the bottom face of the piston-side circular groove 16*a* in the second land portion be 15 to 45 degrees with respect to the axis of a piston, as in the case of that in the top land portion. In either of the foregoing structures, oil escapes into the groove when the piston ascends, so that it is possible to further restrain the ascent of the oil into a combustion chamber.

Supplemental Items of the Embodiments

The present invention has been described above with reference to the foregoing embodiments, but the technical scope of the present invention is not limited to the foregoing embodiments. In the first and second embodiments, for example, the grooves may be have a rectangle or semicircle shape in cross section. Otherwise, the projection or the tapered surface of the notch may be curved.

In the fourth embodiment, the cross section of the ring-side circular groove and the piston-side circular groove is not limited to the shape of V, and may be in the shape of a semicircle, a rectangle, a rotated U, or the like (illustration is omitted in either case). It is preferable, however, that the ring-side circular groove and the piston-side circular groove be in the shape of V in cross section to obtain the further superior trapping effect.

Furthermore, the position of the piston-side circular groove according to the fourth embodiment is not limited to the position opposite to the ring-side circular groove at the top dead center of the piston. For example, the piston side circular groove may be positioned below the liner installation ring at the top dead center of the piston.

Furthermore, also in the first to third embodiments, the piston-side circular groove may be provided in the second land portion of the piston in order to further restrain the ascent of the oil into the combustion chamber.

INDUSTRIAL APPLICABILITY

The invention is not limited to the above embodiments and various modifications may be made without departing from the spirit and scope of the invention. Any improvement may be made in part or to all of the components.

The present invention is suitable for restraining oil consumption due to the scattering of oil into a combustion chamber in an internal combustion engine having a liner installation ring.

The invention claimed is:

1. An internal combustion engine comprising:

a cylinder block having one or more cylinders;

a cylinder liner with a tubular shape, disposed inside said cylinder;

a piston reciprocating inside said cylinder liner and having a top land portion formed of an outer periphery of the piston sandwiched between a piston head and an uppermost ring groove; and a liner installation ring forming a circular step portion inside the cylinder, and disposed in said cylinder block or said cylinder liner in such a manner that a bottom face of the liner installation ring faces to an uppermost portion of said cylinder liner, the circular step portion protruding to an inner periphery of said cylinder liner, wherein:

said liner installation ring is disposed at a position in accordance with a top end position of said top land portion when said piston reaches a top dead center;

a circular projection, in a tapered shape, inclining downwards to the inside of the cylinder from a crosspoint of the bottom face of said liner attachment ring and the inner periphery of said cylinder liner, is formed on the bottom face of said liner installation ring along an inner peripheral end thereof;

an angle that a tapered surface of said projection forms with the inner periphery of said cylinder liner is in a range of 45 degrees to 60 degrees; and said liner installation ring is set to protrude from the inner periphery of said cylinder liner in an inward direction at a length of 0.05 mm or more to 0.5 mm or less.

2. The internal combustion engine according to claim 1, wherein:

a ring-side circular groove is formed in the inner periphery of said liner installation ring in a peripheral direction of the ring.

3. The internal combustion engine according to claim 1, wherein:

a piston-side circular groove is formed in the top land portion of said piston in a peripheral direction of the piston.

4. The internal combustion engine according to claim 2, wherein:

a piston-side circular groove is formed in the top land portion of said piston in a peripheral direction of the piston in such a position to face said ring-side circular groove when said piston reaches the top dead center.

5. The internal combustion engine according to claim 1, wherein:

a piston-side circular groove is also formed in second land portion in the peripheral direction of the piston, the second land portion being positioned below the top land portion of said piston and the uppermost ring groove.

6. The internal combustion engine according to claim 2, wherein:

a longitudinal section of at least one said ring-side circular groove and said piston-side circular groove is V-shaped such that a top face thereof is horizontal or upwardly inclines to a bottom of the groove, and a bottom face thereof is tapered in such a manner that it goes away from the bottom of the groove as it goes downward.

7. The internal combustion engine according to claim 1, wherein:

an external diameter of said liner installation ring is set to be larger than an external diameter of an uppermost portion of said cylinder liner; and a latch step portion is formed in the upper portion of said cylinder of said cylinder block and latches said liner installation ring to restrain its downward movement.

8. The internal combustion engine according to claim 7, wherein:

the uppermost portion of said cylinder liner is positioned above the uppermost ring groove when said piston reaches the top dead center; and the uppermost portion of said cylinder liner is disposed below said latch step portion with a distance.

9. The internal combustion engine according to claim 1, wherein said liner installation ring has open parts in a peripheral direction thereof which face to each other with a predetermined distance, in order to fix said liner installation ring on said cylinder block or said cylinder liner by tension of the open parts separating from each other.

10. A liner installation ring to be applied to an internal combustion engine that comprises a cylinder block having one or more cylinders with a latch step portion in its/their upper portion(s), and a tubular cylinder liner disposed in said cylinder, the liner installation ring being disposed in said latch step portion with its bottom face facing to an uppermost portion of said cylinder liner; while disposed, an inner peripheral end of the ring inwardly protruding from an inner periphery of said cylinder liner to said cylinder to form a circular step portion inside said cylinder, wherein:

a circular projection is provided in the bottom face along the inner peripheral end of the ring;

said projection is formed in a tapered shape such that it downwardly inclines to the inner periphery of the ring from a position of the inner periphery of the cylinder liner when the ring is disposed;

an angle that a tapered surface of said projection forms with the inner periphery of said cylinder is in a range of 45 degrees to 60 degrees; and a length from a position of the inner periphery of the cylinder liner when said liner installation ring is disposed to the inner peripheral end of the disposed ring is set to be in a range of 0.05 mm to 0.5 mm.

11. The inner installation ring according to claim 10, wherein the liner installation ring has open parts at a position in a peripheral direction of the ring, the open parts facing to each other with a predetermined distance.

* * * * *